United States Patent [19]

Niske

[11] Patent Number: 4,848,063

[45] Date of Patent: Jul. 18, 1989

[54] METHOD OF MANUFACTURING PACKAGING CONTAINER

[75] Inventor: Jörgen Niske, Lund, Sweden

[73] Assignee: AB Tetra Pak, Lund, Sweden

[21] Appl. No.: 227,523

[22] Filed: Aug. 2, 1988

[30] Foreign Application Priority Data

Aug. 3, 1987 [JP] Japan ..... 62-194277

[51] Int. Cl.[4] ..... B65B 9/06

[52] U.S. Cl. ..... 53/451; 53/551

[58] Field of Search ..... 53/389, 450, 451, 550, 53/551, 552, 568

[56] References Cited

U.S. PATENT DOCUMENTS

| | | | |
|---|---|---|---|
| 3,048,951 | 8/1962 | Oler | 53/451 |
| 3,082,583 | 3/1963 | Larson et al. | 53/451 |
| 4,027,455 | 6/1977 | Rausing et al. | 53/451 X |
| 4,045,939 | 9/1977 | Baumstingl | 53/451 X |
| 4,384,438 | 5/1983 | Hilmersson | 53/552 X |
| 4,606,174 | 8/1986 | Berg | 53/451 |
| 4,617,779 | 10/1986 | Nygren et al. | 53/451 X |
| 4,784,697 | 11/1988 | Bordini | 53/551 X |

*Primary Examiner*—Robert L. Spruill
*Assistant Examiner*—Beth Bianca
*Attorney, Agent, or Firm*—Koda and Androlia

[57] ABSTRACT

A method for making parallelepiped or brick-shaped containers of greater mechanical strength and better appearance, avoiding any mismatching of the printed patterns due to displaced joints in the middle of the side of the container walls. A longitudinal seal is positioned at the corners rather than on the face of the side walls, thus leaving the side walls without joints or splices. A packaging material web taped coated with thermoplastic material and provided with folding lines is twisted when passing through two bending rollers and one slack-absorbing roller and is converted into a cylindrical shaped and then sealed at the overlapping side edges. The cylindrical container is then filled with a liquid through a filler pipe and sealed at predetermined intervals.

17 Claims, 4 Drawing Sheets

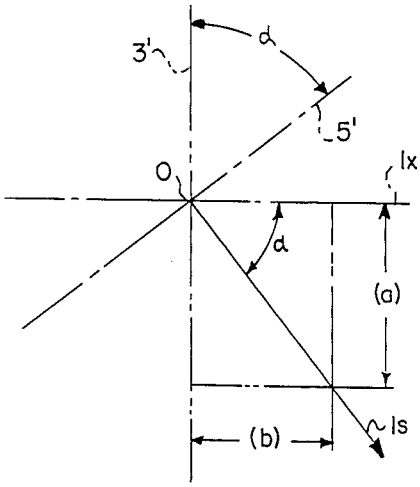
FIG. 5
FIG. 6(a)
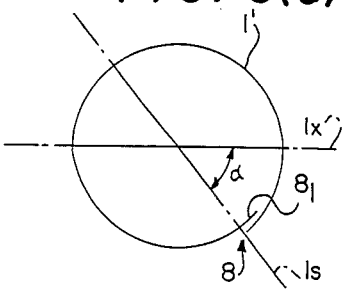
FIG. 7(a)
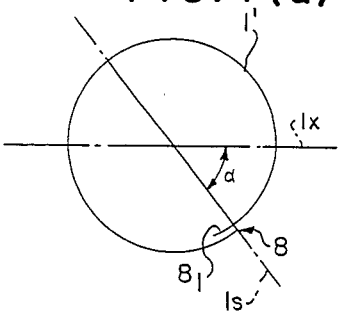
FIG. 6(b)
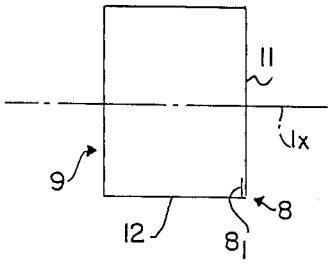
FIG. 7(b)
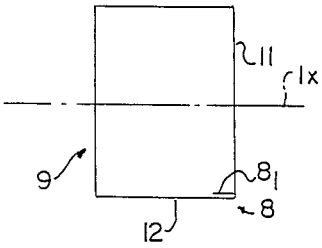

FIG. 8
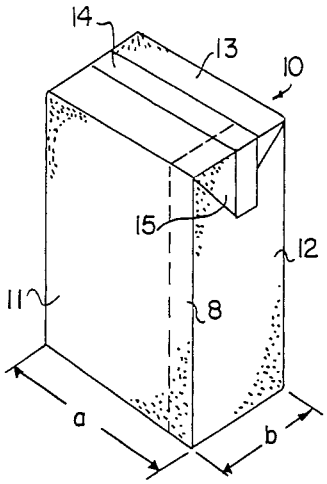
FIG. 9
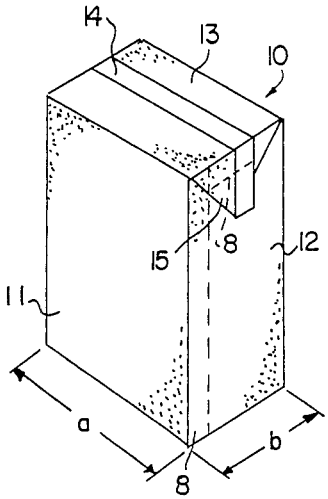
FIG. 12
PRIOR ART
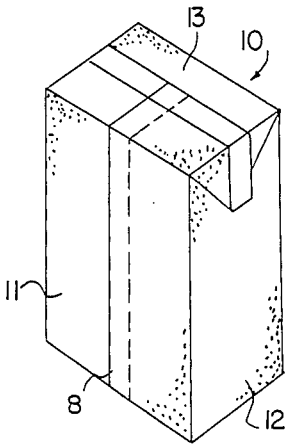
FIG. 10
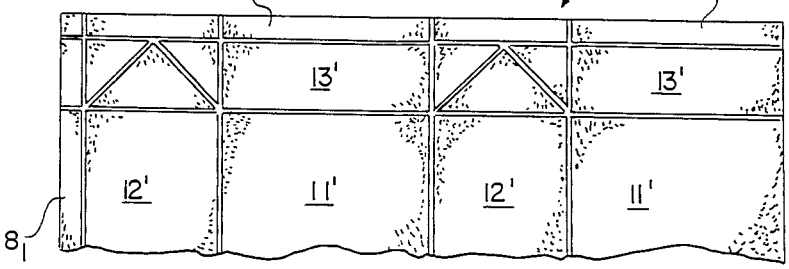
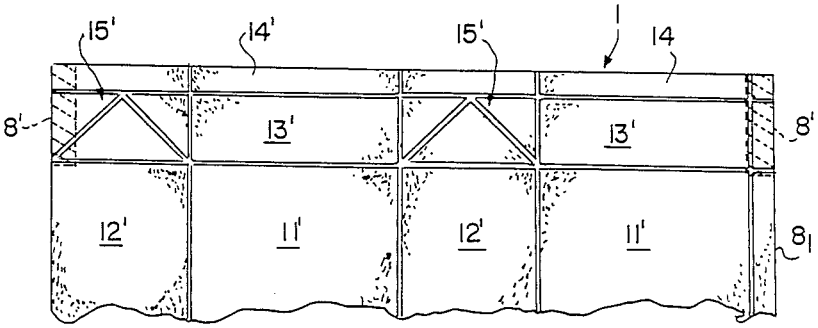
FIG. 11

METHOD OF MANUFACTURING PACKAGING CONTAINER

BACKGROUND OF THE INVENTION

1. Field of the Invention

The present invention relates to a method of manufacturing packaging containers and more particularly to a method of manufacturing parallelepiped packaging containers by positioning the vertically sealed portions of the parallelepiped containers in the corners of the side walls.

2. Prior Art

In the prior art, methods of manufacturing brick-shaped packaging containers filled with liquid foodstuffs such as milk and juice have used a tape-shaped packaging web provided with folding lines and a plastic coating. In the filling section of the packaging machine such a web is shaped into a tubular configuration, filled with the contents, sealed and then cut separately at predetermined intervals. The top and bottom parts of the packaging container blank thus obtained are folded in order to obtain individual parallelepiped-shaped packaging containers.

In order to create the above described tubular configuration, a packaging material web moving laterally on the upper part of the packaging machine is bent down nearly at right angles and the resulting bent web surface is transferred downwards and converted by bending guides into a tubular configuration. The longitudinal edges are heat-sealed together to form a tube with longitudinal liquid-tight sealed spaces which are then filled with the liquid contents. The liquid-tight sealing portion is in the middle of the side surface of the tube. The tube is then filled with a liquid and is shaped into a square crosssection by the molding jaws of a molding and sealing device, which successively opens and closes along the lateral direction of the moving packaging container blanks. As a result, the longitudinal sealing portion zones are formed in the middle of one of the side walls (normally the wider side).

In Japanese Laid-Open Patent Publication No. 56-95807 a device is disclosed wherein the entire lateral sealing device is attached to a turnable base plate for sealing the material tube at predetermined intervals. This base plate is turned to predetermined positions for lateral sealing and produces separated packaging container blanks with longitudinal sealed portions between neighboring side walls.

In existing manufacturing methods for packaging containers it is unavoidable for longitudinal sealed portions to be located in the middle of the side wall along the lateral transferring direction of the packaging container blanks at the point where the material tube is shaped into a rectangle in cross-section under the action of the sealing jaws which open and close in association with the movement of the material web or the above described packaging container blanks (see FIG. 12). Consequently, a part of the printed patterns on the material web is not visible at the middle portion of one of the side walls. Therefore, parallelepiped packaging containers manufactured as described above suffer from the printed patterns abutting in the middle of one of the side walls (usually the wider side), resulting in an unsatisfactory appearance due to the staggering of the printed pattern at the sealed portion. In addition, the mechanical strength at the corner portions of this type of packaging container is reduced due to lack of a sealing joint, resulting in poor dimensional stability.

Another device disclosed in Japanese Laid-Open Patent Publication No. 56-95807, discloses forming longitudinal sealed portions at the side wall corners of the packaging containers. However, practical application of this disclosure is very difficult due to the complicated construction of the entire lateral sealing device which must be turned to a predetermined position for sealing the material tubes at predetermined intervals.

SUMMARY OF THE INVENTION

The object of the present invention is to provide a manufacturing method for packaging containers with higher mechanical strength and better appearance by avoiding staggering of printed patterns at the sealing joints in the middle of one of the side walls. This is achieved by a simple modification in the prior art device so that the longitudinal sealing portion is located at a corner of the container.

The basic manufacturing method for parallelepiped-shaped packaging containers includes the steps of (1) converting a a tape-shaped packaging material web provided with a coating of thermoplastic material and folding lines into a cylindrical configuration, (2) forming heat-seal at the longitudinal edges of the thus obtained cylindrical web, (3) filling the container with the contents, (4) sealing the container at predetermined intervals, (5) cutting individual sealed units, and (6) folding-in the top and bottom triangular portions of the sealed units.

In the present invention, the upper part of the manufacturing device is provided with (A) an upper bending roller with its axis horizontal, for bending downward the lateral feeding movement of the packaging web; (B) a lower bending roller with the axis horizontal located at a predetermined distance below and inclined by a predetermined angle to the axis of the upper bending roller such that a plane between the upper and lower rollers is twisted; and (C) a slack absorbing roller, which is located between the upper and lower bending rollers for pulling in the slack due to twisting of the material web.

During the downward movement of the material web, the facing direction of the flat web surface is inclined (twisted) against the axis of the upper bending roller and the material web is converted into a cylindrical configuration through two bending elements arranged under the lower bending roller. Then, the longitudinal edge portions of the cylindrical web are heat-sealed to provide a space to be filled with liquid, such a longitudinal sealed portion being brought to a corner between two side walls of the packaging container blanks.

Next, the top and bottom sections of the blank are cross-sectionally sealed to form a rectangular shape at predetermined intervals by a molding and sealing device with molding and sealing jaws which are opened and closed, while the material web is being fed downward. Moreover, the above described angle of inclination or twisting (see (B) above) is defined as $\tan^{-1} a/b$, where a is the lateral length of the end wall (top or bottom) of the packaging container and b is the side length of the end wall.

In this invention, the movement of the flat tape-shaped packaging material web is changed in direction from upward to downward by an upper bending roller provided on the upper part of the packaging machine.

To make a cylindrical shape from the flat web and bring the sealing joint of the web to the corner of the resulting brick shaped container, the web is fed such that the direction of the web surface is inclined (twisted) by the upper bending roller and the lower bending roller, the axis of the lower bending roller being inclined (twisted) in relation to the upper bending roller while any slack occuring due to such inclination or twisting of the material web is drawn to one side and is absorbed by a slack absorbing roller provided between the upper and lower bending rollers, resulting in smooth downward movement under the stretching action without any slack in the web.

After welding of the longitudinal edge portions to produce the cylindrical shape and filling the container with the liquid contents, the container is shaped into a rectangle in cross section by the molding and sealing device. This device is opened and closed perpendicular to the downward movement of the web.

Owing to the relation between the difference in direction of the axes of the upper and lower bending rollers, the sealing portions assume a position at the side wall corner of the packaging container blank. This produces strong packaging containers showing no splices in the patterns printed thereon in the middle of one of the side walls (usually, the wider side) when the upper and lower portions of the packaging container blanks are folded in to make the final parallelepiped containers.

BRIEF DESCRIPTION OF THE DRAWINGS

The attached drawings show embodiments of this invention:

FIG. 5 shows the relation between axial directions of the upper and lower bending rollers and the sealing direction;

FIG. 6(*a*) is a view of cross section taken along line A—A of FIG. 2, wherein the right edge of the web is inside the cylindrically shaped web;

FIG. 6(*b*) shows a cross section of the web of FIG. 6(*a*) after being converted into a rectangular shape;

FIG. 7(*a*) is a cross-sectional view of taken along the line A—A of FIG. 2, wherein the left edge portion of the web is inside the cylindrically shaped web;

FIG. 7(*b*) shows a cross section of the web of FIG. 7(*a*) after being converted into a rectangular form;

FIG. 8 is a perspective view of the packaging container manufactured with an overlapping longitudinal sealed portion shown in FIGS. 6(*a*) and 6(*b*);

FIG. 9 is a perspective view of another packaging container with an overlapping longitudinal sealed portion as shown in FIGS. 7(*a*) and 7(*b*);

FIG. 10 is a front view showing a top part of the unfolded packaging material web for the packaging container shown in FIG. 8;

FIG. 11 is a front view showing a top part of the unfolded packaging material web for the packaging container shown in FIG. 9; and FIG. 12 is a perspective view showing an example of a conventional packaging container.

DETAILED DESCRIPTION OF THE INVENTION

The manufacturing method according to this invention will be described in detail with reference to the drawings. This method applies to the content-filling section of a packaging machine for manufacturing brick-shaped packaging containers filled with liquid foodstuff such as milk, juice and others.

Figure 1:
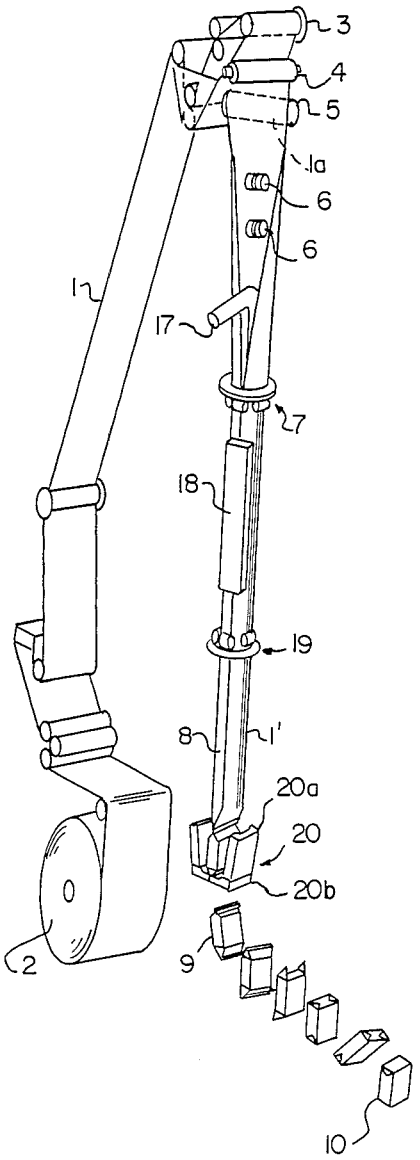
FIG. 1 is a perspective view showing the principle of converting a taped-shaped packaging material web provided with folding lines for packaging containers in a packaging machine used for the method according to this invention.
Figure 2:
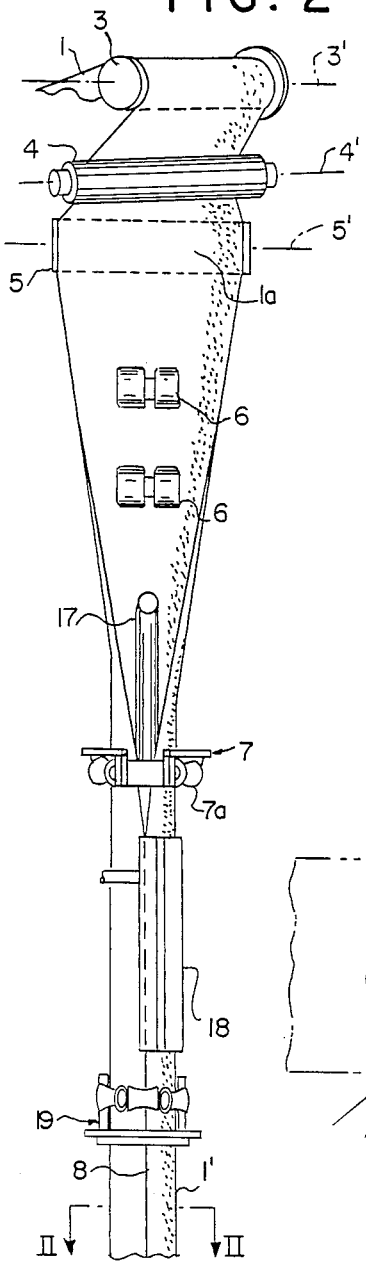
FIG. 2 is a front perspective view of an essential construction elements according to this invention.
Figure 3:
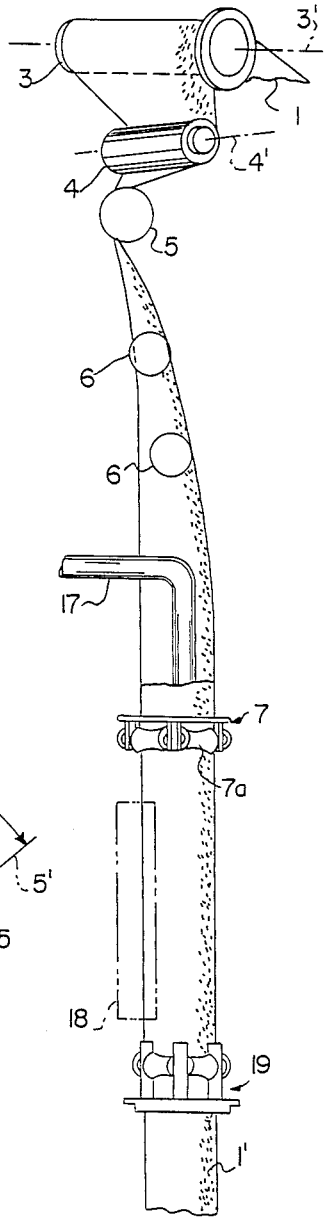
FIG. 3 is a side view of FIG. 2.

FIG. 1 is a perspective view showing the principle for converting a tape-shaped packaging material web provided with folding lines into packaging containers in a packaging machine using the method of this invention. FIG. 2 is a front perspective view showing the essential parts which apply the method of this invention, and FIG. 3 is a side view of FIG. 2.

In the packaging machine (entire illustration thereof is not shown), the packaging material web 1 is stored on a roll 2. The web 1 consists of a core paper support and an aluminum foil layer which is provided with a coating of liquid-tight heat-sealable resin material, normally polyethylene, and predetermined folding lines.

The web 1 is unrolled from a roll 2 and fed upward through a plurality of reversing rollers and guide rollers at a constant feed pitch while processing of the web, including sterilization, is executed. The feeding direction of the web 1 is changed from upward to downward as the web 1 passes through the upper bending roller 3 which has a horizontal axis 3'. A lower bending roller 5 is provided at a predetermined position under the upper bending roller 3. The axis 5' of the roller 5 is horizontal, and has a predetermined angle $\alpha$ against the roller 3 which corresponds to the aspect ratio of the edge surfaces of the packaging containers (to be described later).

Between the upper and lower bending rollers 3 and 5, a slack absorbing roller 4 is provided with its axis 4' slightly inclined (twisted) in the horizontal direction, so that slack (swelling) due to twisting of the web 1 during movement of the web surface 1a in contact with bending rollers 3 and 5 can be drawn in on one side and absorbed, assuring smooth feeding of the web 1 under a slack-free stretched condition.

Figure 4:
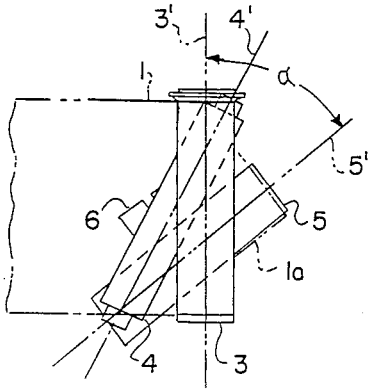
FIG. 4 is a plan view showing different axis directions of three different rollers used in the upper side of the packaging machine.

FIG. 4 is a plan view showing the relative positions of the rollers 3, 4 and 5. FIG. 4 clearly discloses that the web surface la is inclined or twisted in relation to the axis of the upper bending roller 3.

Below the lower bending roller 5, a pair (top and bottom) of web center supporting rollers 6 are provided with a certain amount of displacement in the horizontal direction in order to support the center of the web 1. The web 1 is bent into an arc so that a smooth cylindrical configuration of the downwardly moving web is assured by a molding ring 7 with a plurality of small-diameter barrel-shaped rollers 7*a* underneath the web center support rollers 6.

The filling tube 17 is inserted sideways towards the center of the cylindrical web with respect to the vertical feeding direction of the web at a point below the web center support rollers 6 and above the molding ring 7. The tube 17 is bent downwards at a right angle and extended to a predetermined filling position below.

A hot air nozzle 18 is provided below the molding ring 7 along the route of the thus cylindrically configured material web 1. The nozzle 18 heats the two longitudinal side edge portions of the cylindrical material web 1 prior to melt-sealing them.

The outside of the cylindrical web 1 is supported by a lower molding ring 19 positioned below the nozzle 18, and the two overlapping edge portions of the web 1 are fused together from the inside by the pressure of a press roller (not shown) for longitudinal sealing so that a material tube 1' is obtained. The material tube 1' is filled with liquid through the filled tube 17 as the tube 1' moves downward.

The material tube 1' thus filled with liquid is then shaped into a rectangle in cross section by the molding jaws 20*a* of a molding and sealing device 20. These jaws 20*a* are opened and closed perpendicular to the movement of the material tube 1'. Sealing jaws 20*b* laterally seal the tube 1' at predetermined intervals and cut off individual packaging container blanks 9.

When the web 1 is sealed into a cylindrical shape as described above, the direction of the sealed portion 8 of the two overlapping longitudinal edges of the web 1 pass through the center of the cylindrical material tube 1'. The web 1 is then inclined or twisted laterally with relation to the feeding movement (the direction shown by the line 1x). Such inclination or twisted angle is defined as $\alpha = \tan^{-1} a/b$, where a is the lateral edge length of the end wall 13 (see to FIG. 8 and FIG. 9) of the packaging container to be manufactured, and b is the side edge length of the end wall 13.

More specifically, referring to FIGS. 6 and 7, is defined as the angle of inclination or twisted angle between the axis 3' of the upper bending roller 3 and the axis 5' of the lower bending roller 5. The crossing point of these two axes is O, and line 1x perpendicular to the axis 3' with the respect to the crossing point O indicates the initial direction of movement of the material web 1, while another line 1s perpendicular to the axis 3' with respect to the crossing point O indicates the direction of the seal portions 8. The lines 1x and 1s thus make the angle $\alpha$, so that the seal portions 8 are brought into the direction of the line 1s.

Consequently, when the molding jaws 20*a* of the molding and sealing device 20 are opened and closed to form rectangular cross sections for the container, the joining lines of the corresponding seal portions 8 are at the side edges of the rectangular forms, i.e., at corners of the packaging container blanks 9 obtained (FIGS. 6(*a*) and 7(*b*)). When the blanks are laterally transferred, i.e. the initial lateral direction of the feeding movement of the web, on a conveyer (not shown), top and bottom lateral seal portions of the blank 9 are shaped into triangular flaps 15 and folded in from the right and left sides onto the top portion (the bottom of the finished packaging container) and the side wall of the blank 9 to make the desired parallelepiped shaped packaging container.

When producing a cylindrical configuration and applying longitudinal sealing to the web 1, i.e., when sealing the longitudinal edges of the container side walls, the position of the longitudinal seal portions 8 relative to the side walls of the container 10 varies depending upon the inside positioning of either the right or left edge portion of the web 1 as it moves downwards. In FIG. 6(*a*), the right side edge 8 of the downward moving web is brought inside of the cylindrical tube 1'. The line 1x indicates the lateral moving direction of the web 1 crossing at the angle of inclination or twisting angle $\alpha$ with another line 1s indicating the sealing direction of the material web passing through the center of the cylindrical form. As shown in FIG. 10, the longitudinal sealed flap $8_1$ of the web 1 which is the inside edge is displaced side-ways from line 1*s* (indicating the sealing direction) to line 1x (indicating the lateral direction of movement of the web). After being molded by the molding jaws 20*a* of the molding and sealing device 20 the longitudinal sealed flap $8_1$ is located in the back of the side wall 11 on the side of the line 1x which indicates the moving direction of the container blank 9, as shown in FIG. 6(b), which is a cross sectional view from the bottom of the container 10 to be finished, so that when finished as shown in FIG. 8, the longitudinal seal portion 8 is inside the corner of the side wall 11 of the lateral edge (length=a) of the container end wall 13.

In FIG. 6(*b*) (in contrast to FIG. 6(*a*)), the left edge portion as viewed in the direction of movement of the downwardly moving web is located inside the cylindrical material tube 1'. However, the longitudinal sealed flap $8_1$ (FIG. 11) of the web 1, the inside edge portion thereof is brought into the opposite side of the line 1x which represents the lateral being moved direction of the material web, from the line 1*s*. Therefore, as shown in FIG. 7(*b*), the longitudinal sealed flap $8_1$ after molding by the molding jaws 2*a* of the molding and sealing devices 20, is positioned on the back of the side wall parallel to the line 1x which indicates the moving direction of the container blank 9.

FIG. 7(*b*) shows a cross sectional view from the bottom of the packaging container 10, wherein the longitudinal seal part 8 is inside corner, as shown in FIG. 9, of the side wall 12 of the side edge (length =b) of the containers end wall 13 when finished as a packaging container.

As clearly understood from FIG. 9, the upper part of the longitudinal seal part 8 is positioned along the folding line of the triangular flap 15 over the side wall 12. As a result, it becomes difficult to fold the triangular flap 15, because an additional paper thickness appears in the longitudinal sealed flap $8_1$. When portions 8' at the triangular flap 15 of the longitudinal seal portion 8 are reduced in thickness to, for example, one half by grinding as shown in FIG. 11, there is no thickness increase at the folding portion of the triangular flap, assuring the same folding and adhering effects as in the prior art.

As disclosed in the embodiment of this invention, the longitudinal seal portion 8 of the packaging container 10 is positioned at the corner of the side wall of the container 10. THe reason for this is because prior to the filling process of the packing containers the web surface la of the packaging material web 1 is inclined or twisted to the initial lateral direction of feeding movement, i.e. to the closing and opening direction of the molding jaws of the molding and sealing device 20.

In the embodiment, it is preferable from a manufacturing viewpoint that the longitudinal sealed flap $8_1$ of the material web be positioned inside of the side wall 11, which is the lateral edge side (lateral transporting direction side of the packaging material web 1 or the packaging container blank 9) of the end wall 13 of the packaging container 10 (see FIGS. 6(*b*) and 9).

However, when the sealed flap $8_1$ i positioned (see FIGS. 7(*b*) and 9) inside of the side wall 12 which is narrower in width than the wall 11 and on the side edge side of the end wall 13 of the packaging container 10, rigidity over entire surface of the side wall 12 is improved. Furthermore, as shown in FIG. 9, the longitudinal sealed portion 8 on the narrower side wall 12 is advantageous when the packaging container is gripped over the entire surface of the side wall 12, though manufacture is somewhat complicated.

In FIG. 9, reference numerals 11 and 12 are the side wall forming panels, 13 is an end wall forming panel, 14 is a lateral seal tab forming panel, and 15 is a triangular flap forming panel.

The invention described in detail above is a process of producing packaging containers which are of superior strength and able to withstand rough handling. The containers do not have joints in the middle of the side walls and can be easily manufactured via a modification to conventional packaging machines without the application of any complicated device. This process forms and seals a packaging material web into a cylindrical configuration by feeding the web surface in an inclined or twisted manner with relation to the opening and molding direction of the molding jaws of the molding and sealing device by the upper and lower bending rollers and a slack-absorbing roller arranged between the upper and lower bending rollers. In this way, the longitudinal sealed portions of the packaging container are at corners of their side walls, leaving the containers joint-free in the middle of the side walls.

I claim:

1. A method of manufacturing a parallelepiped packaging container comprising the sequential steps of: forming preliminary creased tape-shaped packaging material coated with thermoplastic resin into tubular configuration; thermally fusing lengthwise edge portions of said web; charging contents thereinto; sealing said web at specific lengthwise intervals; separating thus sealed objects into individual units; and inwardly folding the upper and lower portions before eventually forming a complete parallelepiped packaging container; wherein a manufacturing apparatus for said method is provided with a plurality of functional rollers including an upper bending roller which is installed to a specific position above said manufacturing apparatus and provided with horizontally disposed axially line for turning the movement of said packaging material web in a downward direction, lower bending roller which is installed below said upper bending roller, said lower bending roller being provided with an axial line at a specific angle against said axial line of said upper bending roller; and a slack absorbing roller which is installed between said upper and lower bending rollers for absorbing slack from said packaging material web while it is being moved between said upper and lower bending rollers so that the slack caused by distortion of said web can be eliminated; wherein said manufacturing apparatus executes operations for manufacturing packaging containers comprising the sequential steps of: allowing a surface of said web to incline against the direction of said axial line of said upper bending roller while said packaging material is fed in the downward direction; forming said packaging material web into a tubular configuration by applying tube-forming elements which are installed below said lower bending roller; charging the contents therein after thermal fusion is applied to lengthwise edges of said circular web so that a vertically sealed portion is positioned at a corner of side walls of a packaging container blank when said circular web is sealed into a square configuration in cross section at specific intervals by a sealing device which opens and closes in the direction of the lateral movement of said packaging material web.

2. A method of manufacturing packaging containers defined in claim 1, wherein the direction of an axial line of said slack-absorbing roller is oriented in between said axial lines of said upper and lower bending rollers when viewed from the top, and said axial line of said slack absorbing roller slightly inclines against the horizontal level.

3. A method of manufacturing packaging containers defined in claim 1 or 2, wherein said inclined angle between said axial line of said lower bending roller 5 and said axial line of said upper bending roller is denoted $\alpha = \tan^{-1} a/b$, where the antilogarithm of tangent is expressed in terms of the ratio relationship a/b, a being the length of the end wall of the packaging container b being the width of the end wall thereof.

4. A method of manufacturing package containers defined in either claim 1 or 2, wherein element for forming said web into a tubular configuration disposed below said lower bending roller are substantially comprised of a forming ring having a plurality of hourglass-shaped rollers which are disposed in an annular formation, and web-center supporting rollers which are respectively disposed above the axial line of said forming ring.

5. A method of manufacturing packaging containers as defined in either claims 1 or 2, wherein a vertically sealed flap is placed on the right side of the moving direction of said web when forming tubular material by moving said packaging material web downward before eventually forming said web into a tubular configuration.

6. A method of manufacturing packaging containers defined in either claims 1 or 2, wherein a vertically sealed flap is placed on the left side of the web moving direction when forming tubular material by moving said packaging material web downward before eventually forming said web into a tubular configuration.

7. A method of manufacturing packaging containers defined in claim 5, wherein vertical sealing portions of said web respectively have reduced thicknesses, and said sealing portions overlap each other to allow formation of a triangular flap of the packaging container made from said packaging material web.

8. A method of manufacturing package containers defined in claim 3, wherein element for forming said web into a tubular configuration disposed below said lower bending roller are substantially comprised of a forming ring having a plurality of hourglass-shaped rollers which are disposed in an annular formation, and web-center supporting rollers which are respec-tively disposed above the axial line of said forming ring.

9. A method of manufacturing packaging containers as defined in claim 3, wherein a vertically sealed flap is placed on the right side of the moving direction of said web when forming tubular material by moving said packaging material web downward before eventually forming said web into a tubular configuration.

10. A method of manufacturing packaging containers as defined in claim 4, wherein a vertically sealed flap is placed on the right side of the moving direction of said web when forming tubular material by moving said packaging material web downward before eventually forming said web into a tubular configuration.

11. A method of manufacturing packaging containers as defined in claim 8, wherein a vertically sealed flap is placed on the right side of the moving direction of said web when forming tubular material by moving said packaging material web downward before eventually forming said web into a tubular configuration.

12. A method of manufacturing packaging containers defined in claim 3, wherein a vertically sealed flap is placed on the left side of the web moving direction when forming tubular material by moving said packaging material web downward before eventually forming said web into a tubular configuration.

13. A method of manufacturing packaging containers defined in claim 4, wherein a vertically sealed flap is placed on the left side of the web moving direction when forming tubular material by moving said packaging material web downward before eventually forming said web into a tubular configuration.

14. A method of manufacturing packaging containers defined in claim 8, wherein a vertically sealed flap is placed on the left side of the web moving direction when forming tubular material by moving said packaging material web downward before eventually forming said web into a tubular configuration.

15. A method of manufacturing packaging containers defined in claim 3, wherein vertical sealing portions of said web respectively have reduced thicknesses, and said sealing portions overlap each other to allow formation of a triangular flap of the packaging container made from said packaging material web.

16. A method of manufacturing packaging containers defined in claim 4, wherein vertical sealing portions of said web respectively have reduced thicknesses, and said sealing portions overlap each other to allow formation of a triangular flap of the packaging container made from said packaging material web.

17. A method of manufacturing packaging containers defined in claim 8, wherein vertical sealing portions of said web respectively have reduced thicknesses, and said sealing portions overlap each other to allow formation of a triangular flap of the packaging container made from said packaging material web.

* * * * *